United States Patent [19]

Krueger

[11] Patent Number: 4,459,824

[45] Date of Patent: Jul. 17, 1984

[54] ICE CUBE MAKING APPARATUS

[75] Inventor: Harvey R. Krueger, Sleepy Hollow, Ill.

[73] Assignee: Reynolds Products Inc., Schaumburg, Ill.

[21] Appl. No.: 411,644

[22] Filed: Aug. 26, 1982

[51] Int. Cl.[3] ..... F25C 1/12

[52] U.S. Cl. ..... 62/347; 62/348; 62/352

[58] Field of Search ..... 62/347, 348, 352, 73, 62/74, 353

[56] References Cited

U.S. PATENT DOCUMENTS

| | | | |
|---|---|---|---|
| 2,612,030 | 9/1952 | Ploeger | 62/352 |
| 2,997,861 | 8/1961 | Kocher et al. | 62/347 |
| 3,380,261 | 4/1968 | Hendrix et al. | 62/352 X |
| 3,430,452 | 3/1969 | Dedricks et al. | 62/347 X |
| 4,199,956 | 4/1980 | Cunde | 62/352 X |
| 4,255,941 | 3/1981 | Bouloy | 62/347 |
| 4,344,298 | 8/1982 | Biemiller | 62/347 |
| 4,366,679 | 1/1983 | Van Steenburgh, Jr. | 62/347 |
| 4,366,856 | 1/1983 | Yanadori et al. | 62/352 X |

*Primary Examiner*—William E. Tapolcai

*Attorney, Agent, or Firm*—Shenier & O'Connor

[57] ABSTRACT

An ice cube maker in which a generally vertically disposed array of fins including first fins extending laterally outwardly from one side of a central vertical plane and second fins extending outwardly from the other side of the plane is disposed over an open top tank to which a predetermined volume of water supplied at the beginning of an ice-making operation in the course of which water from the tank is fed to a distributor over the tank so as to fall downwardly into the fins which are cooled to form ice. When water in the tank reaches a predetermined low level the ice is harvested by heating the fins to permit the ice to falls into a bin below the array. In response to movement of ice into the bin a new cycle is initiated.

8 Claims, 8 Drawing Figures

ICE CUBE MAKING APPARATUS

FIELD OF THE INVENTION

My invention relates to the field of ice making apparatus and, more particularly, to the field of ice cube making apparatus of the batch type.

BACKGROUND OF THE INVENTION

Various types of ice makers are known in the prior art. In one type of ice maker, crystals of ice are scraped off a freezing surface and are forced through extruding passages to form rods of ice which are broken into pieces and stored in a chamber. Ice makers of this type are not suited for the production of large quantities of ice pieces or cubes in a relatively short period of time.

It is to be understood that where the term "cubes" is used herein to describe a piece of ice, it is intended to cover pieces of any shape in addition to a cube. It will readily be apparent that in most instances the pieces of ice being formed are not perfect geometric cubes.

There are known in the prior art "batch" ice makers for forming a relatively large number of ice pieces or "cubes" in a relatively short period of time. In these devices a plurality of individual ice cubes are simultaneously formed in batches and are harvested when they have reached a predetermined size. In most of these batch ice makers of the prior art, water is fed into compartments, the walls of which are first chilled to cause a buildup of ice in the compartment until the pieces of ice have been formed, at which point the walls are heated to release the ice pieces.

U.S. Pat. No. 3,220,214 to Cornelius discloses one such device in which a ring of spaced thermally conductive fins extend downwardly from a set of horizontally disposed refrigeration coils. A spray of water is directed upwardly and outwardly onto the fins from a sump disposed below the fins and coolant is supplied to the coils to cause ice to build up on the fins. When the refrigerating coils reach a predetermined low temperature, the coolant flowing through the coils is replaced by hot gas and the fins are heated to release the ice pieces and permit them to fall to a storage bin.

While the ice cube maker disclosed in Cornelius functions in a generally satisfactory manner, it suffers from a number of disadvantages. First, owing to the arrangement of the fins, the apparatus requires a large housing and unduly limits the number of fins which may be used. Secondly, the construction of the machine renders cleaning relatively difficult. Thirdly, harvesting in response to the temperature of the refrigerating coils does not afford an accurate measure of the size of the ice pieces which have been formed at the time of harvesting.

SUMMARY OF THE INVENTION

One object of my invention is to provide an ice cube making machine which is relatively small in size for the amount of ice produced during a cycle of operation.

Another object of my invention is to provide an ice cube making machine which may be easily cleaned.

Still another object of my invention is to provide an ice cube making machine which is self-diagnostic, thus facilitating trouble-shooting.

A further object of my invention is to provide an ice cube making machine which is simple in construction.

A still further object of my invention is to provide an ice cube making machine which incorporates a water distributor which may be easily removed and cleaned.

An additional object of my invention is to provide an ice cube making machine which overcomes the defects of those of the prior art.

Other and further objects of my invention will be apparent from the following description.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1A:
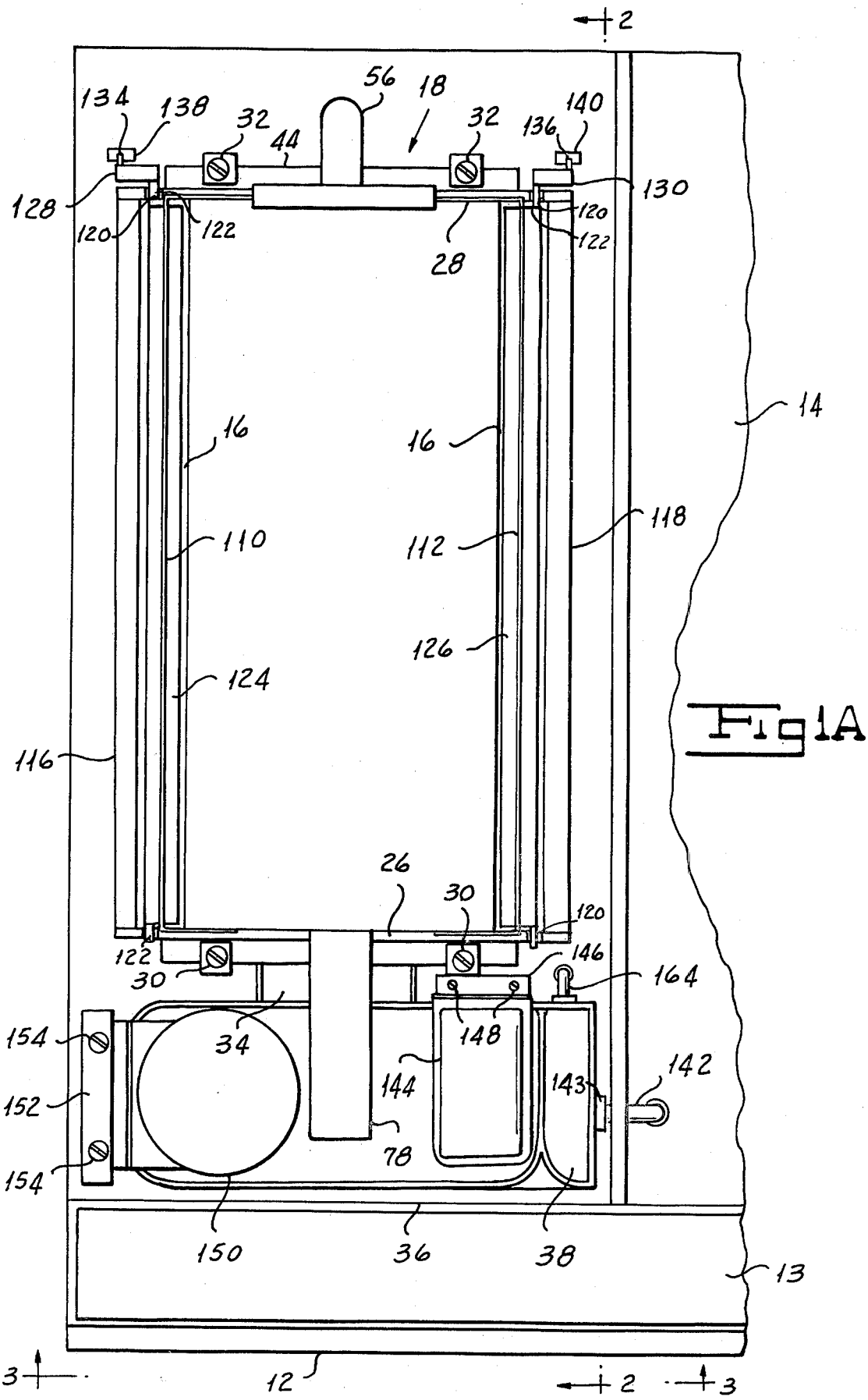
FIG. 1A is a fragmentary top plan of a portion of my ice cube making apparatus.
Figure 1B:
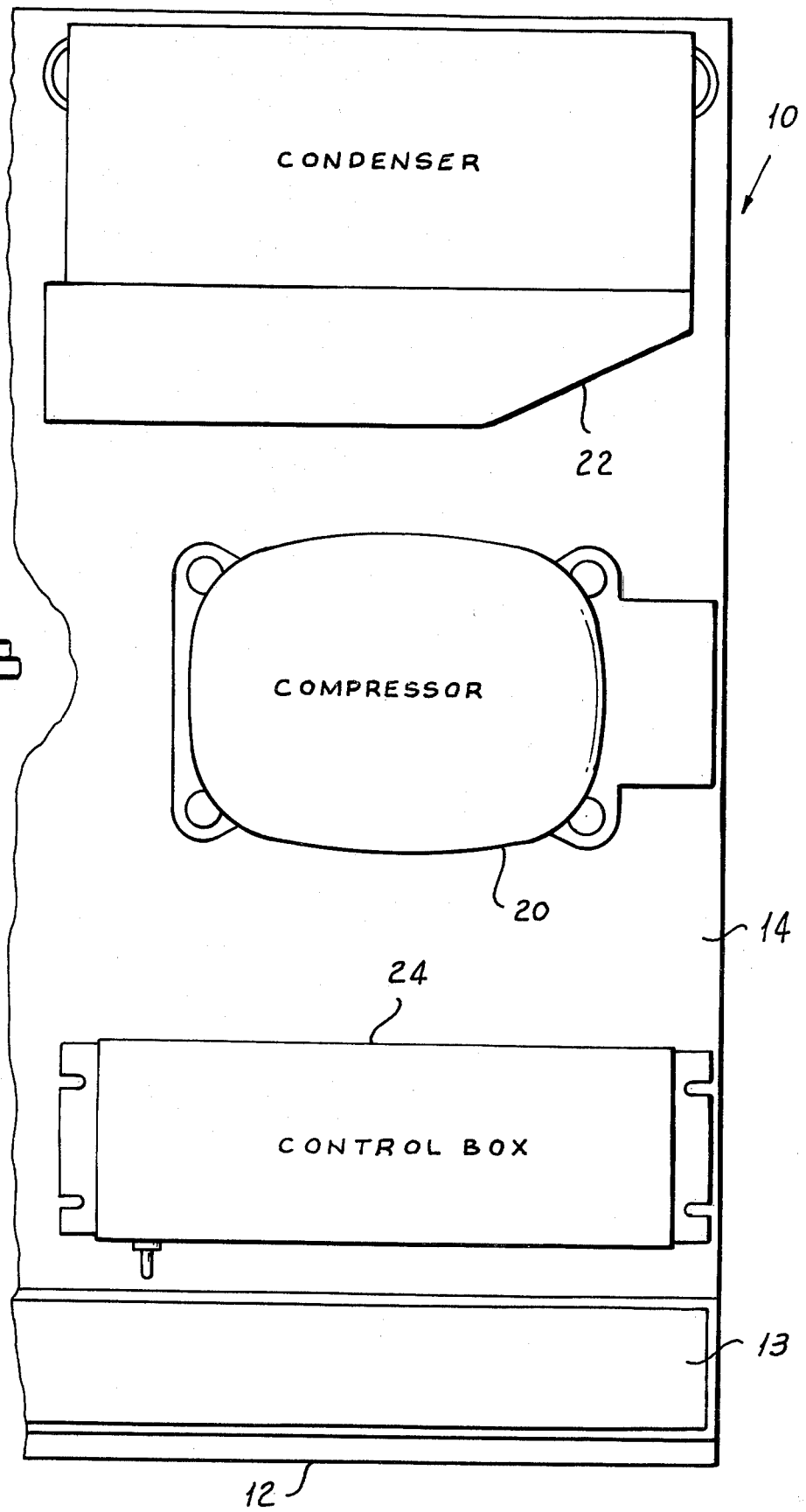
FIG. 1B is a fragmentary top plan of the remaining portion of my ice cube making apparatus.
Figure 2:
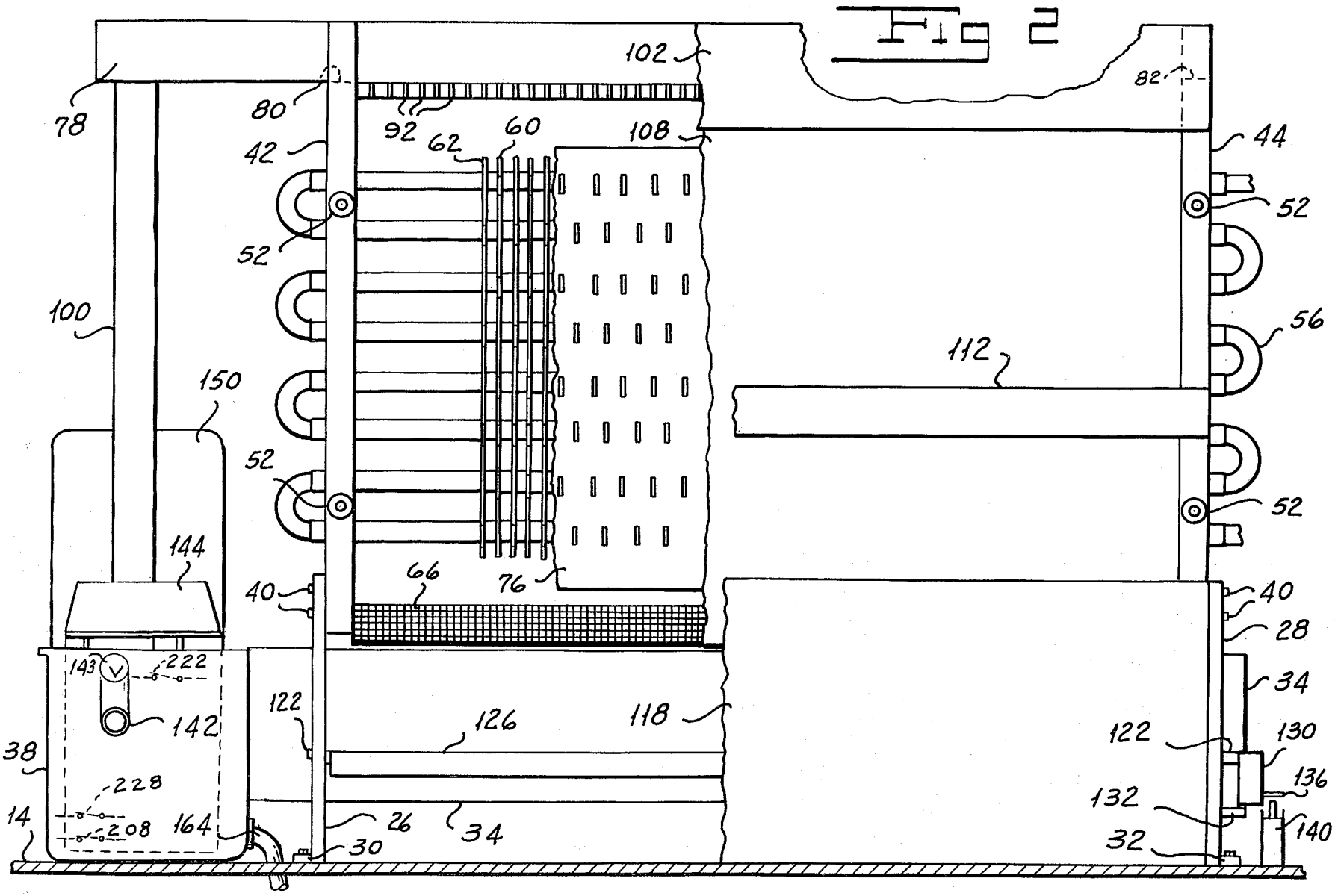
FIG. 2 is a fragmentary end elevation of my ice cube making apparatus with parts broken away and shown in section taken along the lines 2—2 of FIG. 1.

Referring now to FIGS. 1A, 1B and 2, my ice cube making apparatus, indicated generally by the reference character 10 includes an ice storage bin 12 provided with an access door 13 and adapted to carry a base plate 14 having a generally rectangular opening 16 over which the ice maker, indicated generally by the reference character 18, is assembled. The base plate 14 also supports the compressor 20 the condenser 22 and the control circuit box 24 of the refrigerating system associated with the ice maker 18.

The ice maker 18 is secured to a pair of spaced, generally rectangular uprights 26 and 28, secured to the base plate by screws 30 and 32. Uprights 26 and 28 are formed with rectangular openings which receive a water trough 34, which extends over the length of the opening 16 but not completely across the width thereof. Trough 34 empties into a sump 36, located on the base plate 14 adjacent the ice maker 18, having a duct tank 38 in which mineral deposits and lime accumulate.

Figure 3:
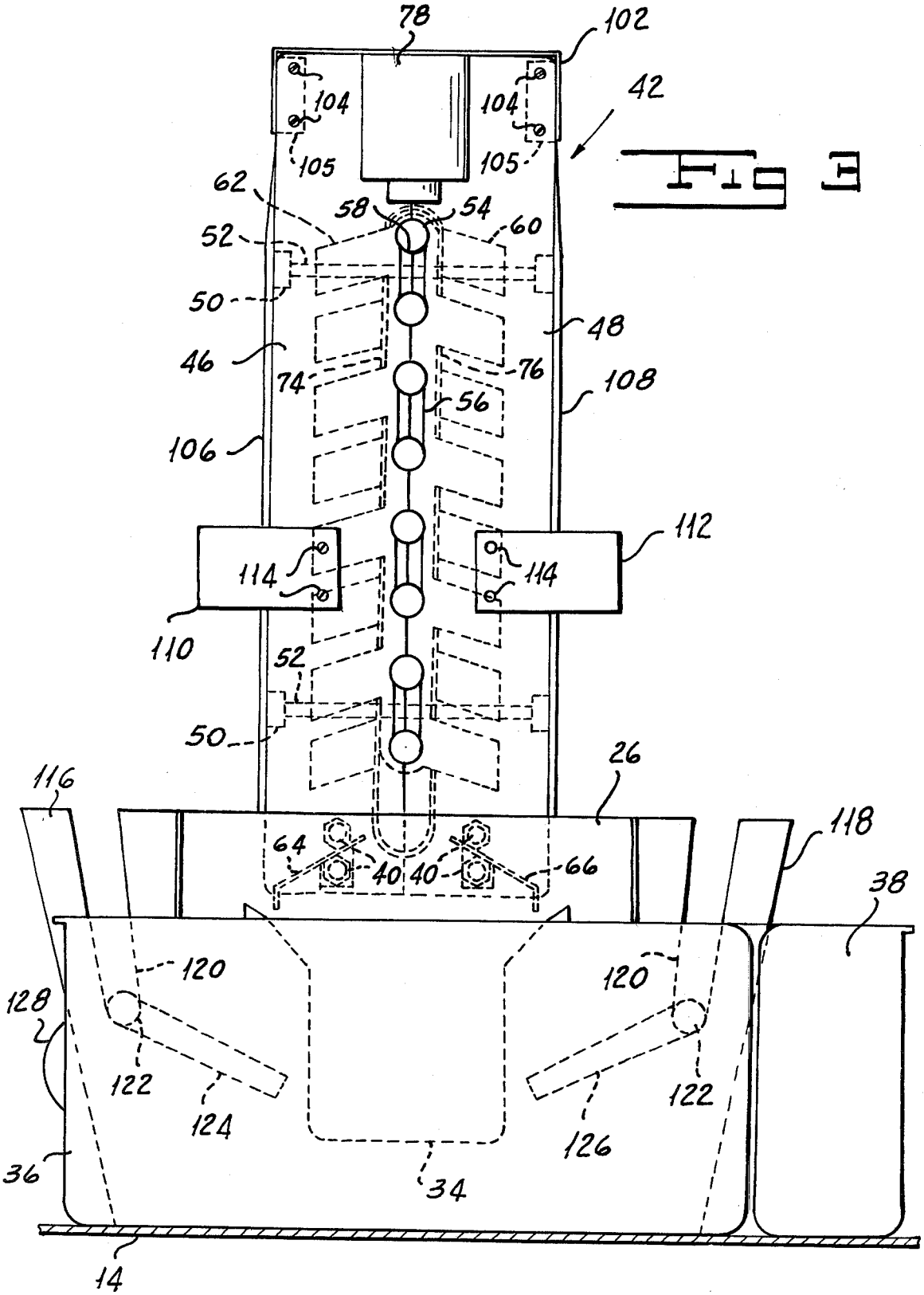
FIG. 3 is a fragmentary side elevation of my ice cube making apparatus with parts shown in section and other parts removed, taken along the lines 3—3 of FIG. 1.

A pair of side plate assemblies 42 and 44 of the ice maker 18 are secured to the uprights 26 and 28 by bolts 40. As best shown in FIG. 3, which shows a side elevation of the ice maker 18 with certain parts removed, each assembly 42 and 44 is formed from two plates 46 and 48 joined by bolts 50 extending through channels 52 in the plates. The inner edges of the side plate assemblies 42 and 44 form a plurality of circular openings 54 adapted to support a continuous length of tubing 56.

The tubing passes through a plurality of vertically spaced openings 58 located in a plurality of alternating first and second fin members 60 and 62, creating a series of tube lengths lying in a vertical plane directly above the water trough 34. Bolts 40 also serve to secure a pair of gratings 64 and 66 to the side-plate assemblies 42 and 44. Each grate extends from a location adjacent to the lower end of the tubing 56 to a respective one of the opposite edges of the trough 34.

Figure 4:
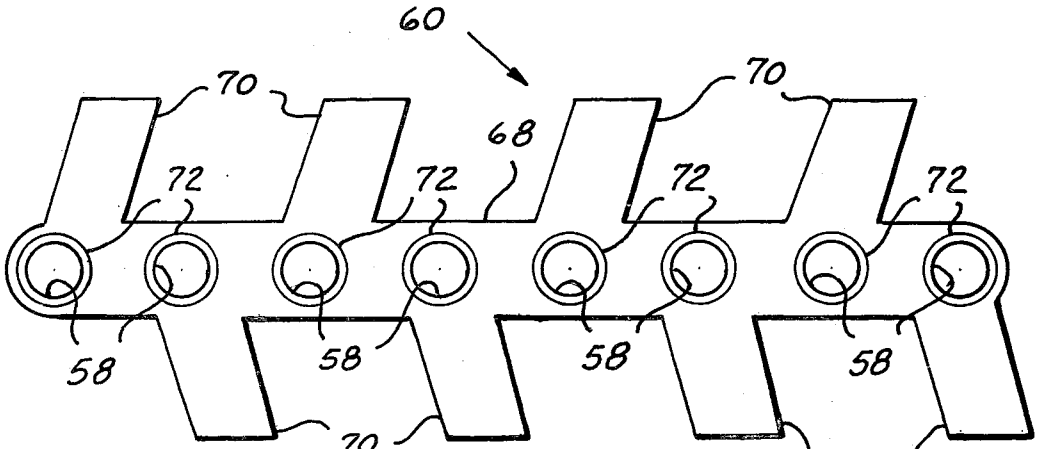
FIG. 4 is a side elevation of one form of fin member incorporated in my ice cube making apparatus.

Referring now to FIGS. 2 and 4, each first fin member 60 is formed with a central portion 68 having a plurality of openings 58 from which extend a plurality of downwardly inclined fins 70 in an alternating side-to-side pattern. Second fin member 62 is a mirror image of first fin member 60. Each opening 58 is surrounded by a flange or collar 72 providing spacing between the fin members. I form members 60 and 62 from any suitable thermally conductive material, such, for example, as copper which is tin plated to prevent corrosion. Fins 70 extend laterally from both sides of tubing 56 through respective plastic covers 74 and 76.

Figure 5:
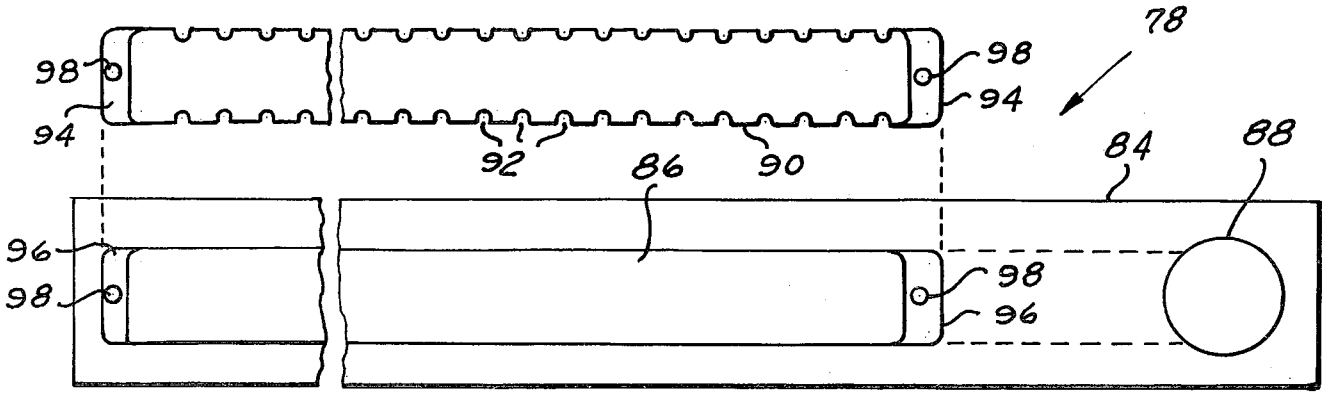
FIG. 5 is an exploded view of the water distributor assembly included in my ice cube making apparatus.

Referring now to FIGS. 2 and 5, side plate assemblies 42 and 44 also support a distributor, indicated generally by reference character 78, in a pair of conformingly shaped notches 80 and 82 formed in the upper ends of assemblies 42 and 44 above the tubing and fins. The distributor includes a generally rectangular hollow housing 84. I form the underside of housing 84 with an elongated rectangular opening 86 extending from adjacent one end of the housing to a location intermediate the ends. I form a circular opening 88 in the underside of housing 84 adjacent to the other end thereof. A rectangular block 90 formed with a plurality of grooves 92 along its edges and a tab 94 at each end is adapted to be received in opening 86. Opening 86 is formed with slots 96 adapted to receive tabs 94. In addition, screw holes 98 are provided in both tabs 94 and slots 96 to receive screws (not shown), to secure the block 90 to the housing 84. Opening 88 is adapted to receive a pipe 100 through which a supply of water is delivered to the distributor 78 so as to be dispersed through the grooves 92 uniformly over the fins 70.

I connect a top plate 102 between side plates 42 and 44 by means of screws 104 extending through end flanges 105 on top plate 102. The top plate 102 carries curtains 106 and 108 which prevent water from splashing out of the ice maker 18. In addition, I connect a pair of ice retainer bars 110 and 112 between side plate assemblies 42 and 44 by means of screws 114 to direct the ice into the opening 16, as will be more fully described hereinbelow.

Referring now to FIGS. 1, 2 and 3, to guide the ice to opening 16 and into the bin 12, I mount a pair of chutes 116 and 118 along the longer edges of opening 16. Each chute is spot welded to the base plate 14 and extends from frame 26 to frame 28 along opposite edges of the opening 16. I form the chutes with slots 120 adapted to rotatably receive pins 122 extending from both ends of a pair of ice doors 124 and 126. In addition, I mount respective counterweights 128 and 130 on the pins of doors 124 and 126 adjacent to wall assembly 44. Counterweights 128 and 130 normally rest on bosses 132, maintaining doors 124 and 126 in their normally closed positions in paths of ice being delivered from fins 70 on opposite sides of ice maker 18. The counterweights are also formed with respective pins 134 and 136, which normally engage the armatures of normally closed microswitches 138 and 140 when the doors are in their closed positions. When, for example, ice door 126 is opened by the weight of falling ice, counterweight 130 moves upwardly and pin 136 releases the armature of microswitch 140 to permit the switch to close. The closure of both microswitches 138 and 140 instructs the control system to end the defrost or harvest cycle, as will be more fully described hereinbelow.

Referring now to FIGS. 1A and 2, a solenoid-operated water inlet valve 143 connects a hose 142 leading from a suitable supply of water to the inlet tank 38 from whence the water flows into the sump 36. A float assembly 144 responsive to the level of water in tank 36 houses a suitable float which opens respective normally closed switches 222 and 228 and a two position switch 208 at various levels of water. For example, as will more fully be explained hereinbelow, switch 208 may be a safety switch for disabling the system upon the failure of the water supply. Switch 228 may be used for initiating the "harvest" cycle and switch 222 may be an adjustable high level switch for initiating the ice making operation.

I position a pump 150, mounted on a suitable frame 152 which is secured to the base plate 14 by screws 154, above the sump 36. Pump 150, when energized, serves to pump water from the sump 36 through pipe 100 to the distributors 78, as shown in FIG. 2.

Figure 6:
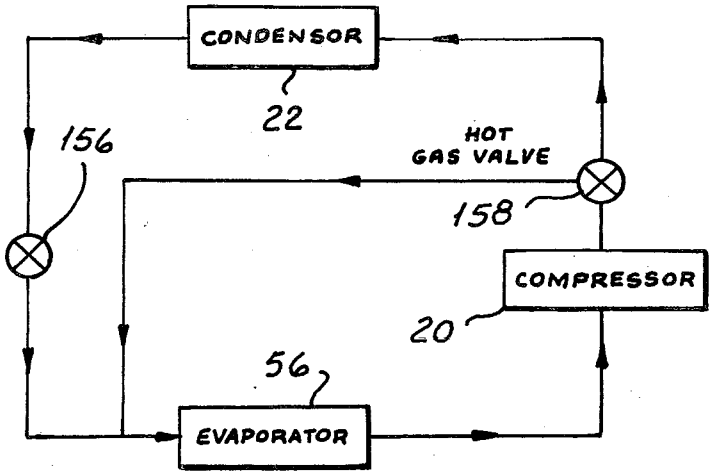
FIG. 6 is a schematic view of one form of refrigerant supply circuit used in my ice cube making apparatus.

Referring now to FIG. 6, the refrigeration system includes a compressor 20 which elevates the refrigerant to a higher pressure and condensing temperature, a condenser 22 in which the refrigerant liquifies, transferring heat to the atmosphere, an expansion valve 156 and an evaporator or tubing 56 in which the refrigerant converts to the gaseous state, absorbing heat from the atmosphere. In addition, the system includes a solenoid operated hot gas valve 158, which, when activated, causes the refrigerant to flow from the compressor 20 directly to the evaporator 56, bypassing the condenser 22. In this arrangement, which I will term the "harvest", the evaporator 56 acts as a condenser, transferring heat to the atmosphere.

Initially, in normal operation of the machine, an amount of water equal to the weight of ice to be produced is fed into the sump 36. When the sump is full, the float actuated high level switch 222 opens, causing the solenoid operated water-inlet valve 143 to close. At this point, refrigerant from the condenser 22 is passed through the expansion valve 156 to the tubing 56, chilling the fins 70. The pump 150 is energized, supplying water to the distributor 78 which disperses the water downwardly over the fins 70 forming ice cubes around each fin from the inside out. The excess water falls into the trough 34 and flows back to the sump 36 where it is re-pumped to the distributor 78.

This process continues until the water in the sump 36 drops below a certain level, at which point the float actuated harvest switch opens to signal the beginning of the defrost cycle. In response, the hot gas valve 152 is actuated, permitting refrigerant to flow directly from the compressor 20 to the tubing 56 which acts as a condenser, transferring heat to the fins 70 to cause the cubes to be released. In addition, water from the sump 36 is intermittently pumped to the distributor 78 and disbursed over the fins 70 to aid in the removal of the cubes. Eventually, the ice falls downwardly and is deflected away from the trough 34 by gratings 64 and 66, which permit water to pass to the trough 34 but direct the ice into the chutes 116 and 118. Retainer bars 110 and 112, together with curtains 106 and 108 ensure that the falling ice does not land outside the chutes 116 and 118.

As the ice falls to the bin 12, ice doors 124 and 126 are moved by the weight of the ice from their normally horizontal position to a more vertical position moving counterweights 128 and 130 upwardly to cause microswitches 138 and 140 to close, as described above. The closure of both microswitches signals the end of the defrost cycle.

The ice, which may be in cube or slab form, enters the bin 12 through the opening 16. Ice deflectors, not shown, may be welded to the roof of the bin 12, to serve to break up the ice slab into cubes and to direct the cubes into the center of the bin.

After each cycle of operation, the duct tank 38 which holds water containing mineral deposits and lime, may be emptied through a dump hose 164. This is controlled by a solenoid operated dump valve, not shown, which, when energized, permits the contents of the tank 38 to empty through hose 164 into a suitable receptacle or drain.

Figure 7:
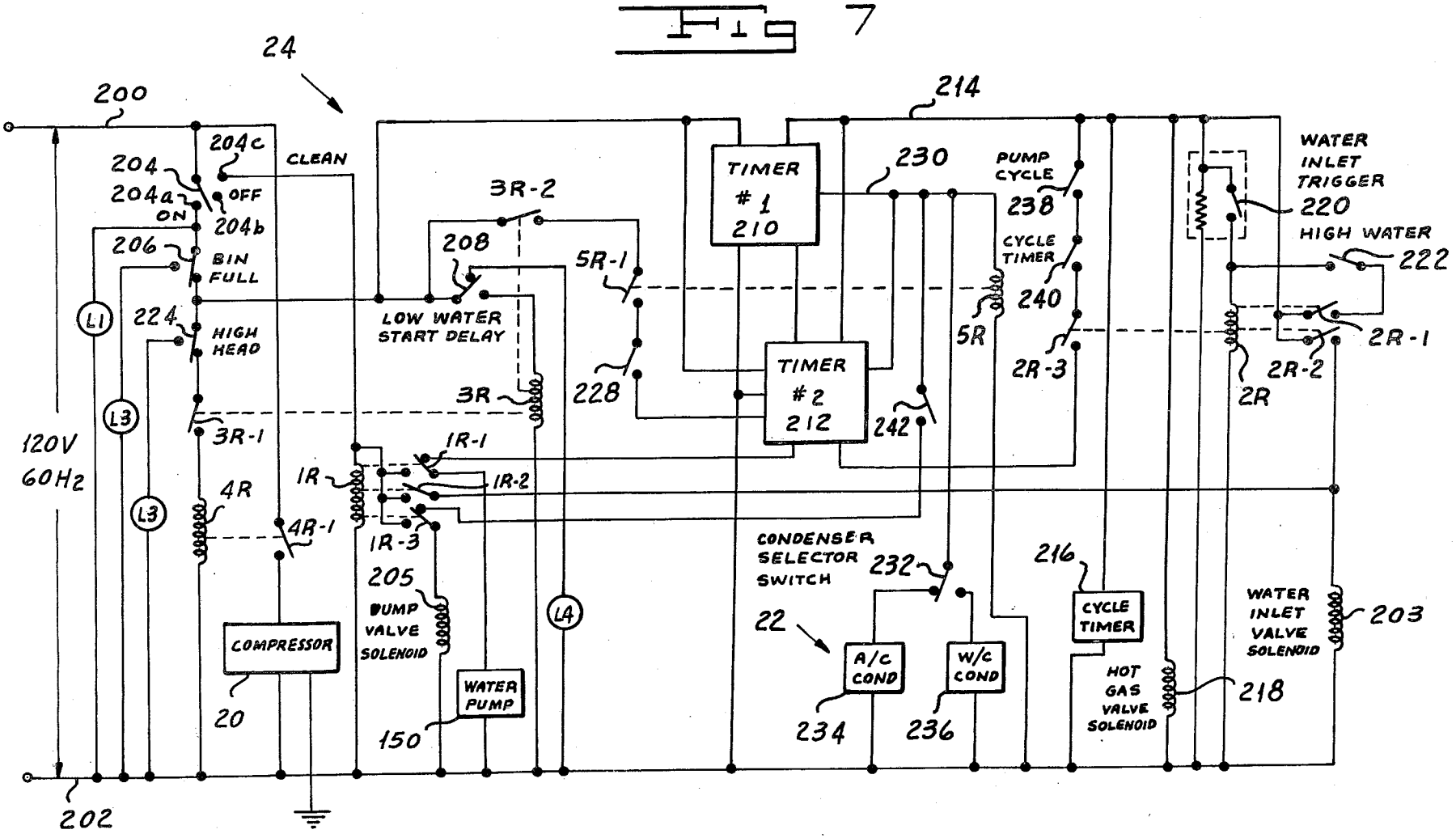
FIG. 7 is a schematic view of one form of electrical control circuit which can be used with my ice cube making apparatus.

Referring now to FIG. 7, the electrical circuitry associated with my ice cube making apparatus, indicated generally by the reference character 24, includes a source of voltage such, for example, as a 120 volt 60 Hz. source having terminals 200 and 202. A switch 204 is adapted to engage either a first contact 204*a*, connecting the power source to the system (on); a second contact 204*b* disconnecting the power source (off); or a third contact 204*c*, enabling a cleaning function (clean).

Upon selection of the cleaning function, relay R1 is energized, moving contacts 1R-1, 1R-2, and 1R-3 from the positions shown in FIG. 7 to their other positions, thereby completing the circuit from terminal 200 to the water pump 150, the water inlet valve solenoid 203, and the dump valve solenoid 205, respectively. In response, water enters the sump tank 36 through the water inlet hose 142 and is delivered to the distributor 78 by the water pump 150. The water passes downwardly over the fins 70 to the water trough 34, flows into the sump 36, and then through the dump hose 164 to a drain, flushing the system. A cleaning solvent may be placed in the sump initially, to be subsequently rinsed away.

When the machine is turned on by moving arm 204 into engagement with contact 204*a*, lamp L1 is illuminated and power is supplied to the circuit through a "bin full" switch 206, shown in its normal position. The switch 206 is adapted to engage its normally open contact when the ice storage bin 12 is full, cutting off power to the circuit and illuminating lamp L2 to disable the ice maker per se and to inform the user that the bin is full. A float operated switch 208 is adapted to engage its upper contact when the level of water in the tank is below a certain level lower than the "harvest" level to be described. In normal operation of the machine if the water supply is functioning properly switch 208 will move into engagement with its lower contact shortly after the machine is turned on. If not, switch 208 remains in its upper positions, lamp L4 lights up to indicate water supply failure and further operation of the machine is inhibited.

A pair of commercial timers 210 and 212 couple terminal 200 through switches 204 and 206 to line 214, energizing cycle timer motor 216 and defrost or hot-gas valve solenoid 218, the function of both to be more fully described hereinbelow. A momentarily closed time delay water inlet trigger switch 220 connects line 214 to relay 2R. Energization of relay 2R closes switches 2R-1 and 2R-2 and opens switch 2R-3. The water-inlet valve solenoid 203, energized through switch 2R-2, opens the valve to fill the sump 36 with water. When switch 220 subsequently opens, the circuit relay 2R is held through switch 2R-1 and the normally closed "high water float" switch 222.

As the sump 36 is filled with water, the "low-water safety-start-delay" switch 208 engages its lower contact, energizing relay 3R to close switches 3R-1 and 3R-2. Relay 4R, energized through switches 3R-1 and "high head" switch 224, closes switch 4R-1 to complete the circuit from terminal 200 to the compressor 20. "High head" switch 224, shown in its normally closed position, is adapted to engage its open contact, cutting off power to the compressor through relay 4R and illuminating the diagnostic lamp L3, in response to an unsafe condition in the compressor 20.

As the water level in the sump continues to rise, the "harvest" or "defrost" float-operated switch 228 closes. When the water reaches a certain level, determined by the cube size desired, the normally closed float actuated high-water switch 222 opens to de-energize relay 2R and water inlet valve solenoid 203, closing the water inlet valve 143. At this point, switch 2R-3 closes, completing the circuit from line 214 to timer 212, signaling the beginning of the freezing cycle. In response, line 214 is de-energized, turning off the cycle timer motor 216 and closing the hot gas valve 158. At the same time line 230 is energized, supplying power to a condenser selector switch 232 and relay 5R. The condenser selector switch 232 affords a choice between an air-cooled 234 or water-cooled 236 condenser and relay 5R, when energized, closes switch 5R-1, completing the circuit to timer 212.

The condenser supplies refrigerant to the evaporator 56 and timer 212 energizes the water pump 150 through switch 1R-1 causing water to flow from the sump 36 through pipe 100 to the distributor 78. The distributor delivers the water uniformly over fins 70, upon which ice cubes are formed from the inside out. The unfrozen water drops into the trough 34 and flows back to the sump 36 where it is repumped to the distributor 78.

As the ice cubes are formed, the amount of water in the sump 36 decreases as less water is returned to the trough 34. When the water in the sump drops to a certain level, the "harvest" or "defrost" float-operated switch 228 opens to signal the end of the freezing cycle and the beginning of the defrost harvest cycle. It should be noted that a certain amount of water remains in the sump 36 to subsequently assist in the removal of the ice from the fins, as will be more fully described hereinbelow.

Upon the opening of switch 228, timer 212 de-energizes the water pump 150 and, together with timer 210, supplies power to line 214, energizing the cycle timer motor 216. As the water inlet trigger switch is open, the water inlet valve solenoid 203 remains de-energized. However, the defrost-hot-gas valve solenoid 218 is energized, opening the hot gas valve to permit refrigerant to pass directly from the compressor to the evaporator tubing 56. The tubing acts as a condenser, transferring heat to the fins 70 to melt the contact surfaces of the ice cubes. After a delay, during which the contact surfaces have substantially melted, pump cycle switch 238 opens and closes to intermittently activate the water pump 150 through timer 212. This causes a small amount of water to be passed over the fins 70 to aid in the removal of the ice.

Eventually, the ice which may be in cube or slab form, falls from the fins 70 to the bin 12 opening ice doors 124 and 126. Upon opening, the doors 124 and 126 activate respective microswitches 138 and 140. When both switches have been actuated, indicating the ice slabs from both sides of the tubing 56 have fallen, cycle timer switch 240 opens to inform timer 212 to end the defrost cycle. If, however, the ice falls as cubes and not in a slab and hence fails to sufficiently open the ice doors to activate the microswitches, the cycle timer motor 216 after a sufficient delay, will open cycle timer switch 240 to end the defrost cycle.

The end of the defrost cycle signals the end of one complete cycle of operation of the ice maker. It may be desirable, at this point, to remove the water remaining in the duct tank 38 before continuing. To this end, dump switch 242 is closed, energizing the dump valve solenoid 205 through switch 1R-3 allowing the sump to empty through hose 164. After the sump is empty, the water inlet trigger switch 220 closes to fill the sump 36 for the next cycle of operation.

It will be seen that I have accomplished the objects of my invention. I have provided an ice cube maker which is relatively small in size for the amount of ice produced and simple in construction. My ice cube making apparatus may be easily cleaned and incorporates a removable water distributor.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Ice cube forming apparatus including in combination, a generally vertically disposed water barrier of thermally insulating material, a plurality of spaced fins of thermally conductive material, each of said fins extending through said barrier from one side thereof and terminating at a predetermined distance from the other side to provide a plurality of discrete freezing elements around which ice may form, means for flowing water over said fins on said other side of said barrier, means on the one side of said barrier for cooling said fins during an ice forming period to cause cubes of ice to form on said fins, and means for harvesting said cubes at the end of said ice-forming period.

2. Apparatus as in claim 1, in which said harvesting means comprises means for heating said fins in a harvesting period following said ice-making period, and means for intermittently feeding water to said flowing means during said harvesting period.

3. Apparatus as in claim 1 in which said water flowing means comprises a tank disposed below said fins, means for filling said tank with water to a first predetermined level at the beginning of a cube-forming operation, means for feeding water from said tank and over said fins and back to said tank in the course of said cube-forming operation and means responsive to a predetermined low level of water in said tank for terminating said cube-forming operation.

4. Apparatus as in claim 1 including a bin disposed below said fins for receiving cubes harvested from said fins, and means responsive to movement of cubes into said bin for initiating a second cube-forming operation.

5. Apparatus as in claim 1 in which said water flowing means comprises a tank disposed below said fins, a distributor head located above said fins, means for filling said tank with water to a first predetermined level at the beginning of a cube-forming operation, means for feeding water from said tank to said distributor and over said fins and back to said tank in the course of a cube-forming operation, and means responsive to a predetermined low level of water in said tank for terminating said cube-forming operation and for initiating a harvesting operation.

6. Ice cube forming apparatus including in combination, respective first and second generally vertically disposed water barriers of thermally insulating material located on opposite sides of a central vertical plane, a generally vertically disposed array of fins of thermally conductive material, said array including a first plurality of fins extending outwardly from a first side of said plane through said first barrier and terminating at a predetermined distance from the other side of the first barrier to provide a plurality of discrete first freezing elements around which ice may form and a second plurality of fins extending outwardly from a second side of said plane through said second barrier and terminating at a predetermined distance from the other side of the second barrier to provide a plurality of discrete second freezing elements around which ice may form, means for distributing water over the portions of said fins on the other sides of said barriers, means disposed between said barriers for cooling said fins during an ice-forming period to cause cubes of ice to from on said fins, and means for harvesting said cubes at the end of said ice-forming period.

7. Apparatus as in claim 6 including a plate-like member of thermally conductive material having a generally vertically extending central body, said first plurality of fins extending outwardly from one vertical edge of said body and said second plurality of fins extending outwardly from the other vertical edge of said body.

8. Apparatus as in claim 7 in which the fins at one edge of said body are vertically staggered with respect to the fins at the other edge of said body and in which said fins are downwardly inclined.

* * * * *